US005182847A

United States Patent [19]

Guse et al.

[11] Patent Number: 5,182,847

[45] Date of Patent: Feb. 2, 1993

[54] METHOD AND APPARATUS FOR MANUFACTURING HOT-ROLLED STRIPS OR SECTIONS FROM CONTINUOUSLY CAST PRIMARY MATERIAL

[75] Inventors: Rudolf Guse, Ratingen; Dieter Nobis, Neuss; Hans Malinowski, Düsseldorf, all of Fed. Rep. of Germany

[73] Assignee: SMS Schloemann-Siemag Aktiengesellschaft, Dusseldorf, Fed. Rep. of Germany

[21] Appl. No.: 710,662

[22] Filed: Jun. 5, 1991

[30] Foreign Application Priority Data

Jun. 5, 1990 [DE] Fed. Rep. of Germany ..... 4017928

[51] Int. Cl.[5] ..... B21B 1/46

[52] U.S. Cl. ..... 29/527.7; 29/33 C

[58] Field of Search ..... 164/476, 417, 269; 29/527.6, 527.7, 33 C

[56] References Cited

U.S. PATENT DOCUMENTS

| | | | |
|---|---|---|---|
| 4,829,656 | 5/1989 | Rohde | 29/527.7 |
| 4,918,803 | 4/1990 | DiGiusto | 29/527.7 X |
| 4,942,656 | 7/1990 | Benedetti et al. | 29/527.7 X |
| 4,976,024 | 12/1990 | Kimura | 164/476 X |
| 4,998,338 | 3/1991 | Seidel et al. | 164/476 X |

FOREIGN PATENT DOCUMENTS

| | | | |
|---|---|---|---|
| 3708050 | 9/1988 | Fed. Rep. of Germany | 164/417 |
| 61-176402 | 8/1986 | Japan | 29/527.7 |

*Primary Examiner*—J. Reed Batten, Jr.
*Attorney, Agent, or Firm*—Anderson Kill Olick & Oshinsky

[57] ABSTRACT

Hot-rolled strips or sections from continuously cast primary material are manufactured in successive work steps in a closed process and arrangement chain. The endless continuously cast primary material is divided after solidification into individual slab pieces of predetermined length. The slab pieces are heated in an equalizing furnace to rolling temperature and are then rolled into the predetermined final dimensions. For bridging a comparatively short interruption, for example, a ten-minute interruption of the rolling process, a slab piece obtained from the uninterrupted casting process is moved into a buffer zone of the equalizing furnace. For bridging relatively long interruptions of the rolling process, primary material obtained during the uninterrupted casting process is divided into slab pieces having a predetermined length, the slab pieces are moved out of the process chain by a furnace part constructed as a transverse conveyor and the slab pieces are conveyed into a side line laterally and parallel offset next to the production line. The slab pieces are stored as necessary and stacked in a holding furnace and, after the interruption has been eliminated, the slab pieces are returned in the reverse direction into the process chain.

17 Claims, 4 Drawing Sheets

METHOD AND APPARATUS FOR MANUFACTURING HOT-ROLLED STRIPS OR SECTIONS FROM CONTINUOUSLY CAST PRIMARY MATERIAL

BACKGROUND OF THE INVENTION

1. Field of the Invention

The present invention relates to a method for manufacturing hot-rolled strips or sections from continuously cast primary material in successive work steps in a closed process chain, wherein the endless continuously cast primary material is divided after solidification into individual slab pieces of predetermined length, the slab pieces are heated in a temperature equalizing or soaking furnace to rolling temperature and are then rolled into the predetermined final dimensions, and wherein, for bridging a comparatively short interruption, for example, a ten-minute interruption of the rolling process, a slab piece obtained from the uninterrupted casting process is moved into a buffer zone of the equalizing furnace.

The present invention further relates to an arrangement for carrying out the above-described method.

2. Description of the Related Art

The manner of operation described above, i.e., the so-called compact strip production or CSP technology, constitutes a closed process chain with a corresponding closed arrangement chain from the steel mill to the finished coil.

In the above-described closed chain, the casting machine and the rolling mill are directly connected to each other through a temperature equalizing furnace. Oscillating shears are arranged in front of the equalizing furnace for cutting the strips emerging from the casting machine at a speed of, for example, 5.4 m/min to a length corresponding to a predetermined strip weight, for example, a length of 50 m. The strip piece then travels at casting speed through the heating zone of the equalizing furnace and subsequently through the equalizing zone of the equalizing furnace at casting speed or conveying speed in accordance with the given requirements.

The strip is accelerated from the equalizing zone to the speed of the initial pass in the finishing train. The strip then travels at this speed as required through a high-pressure descaling unit and enters a first stand of the rolling mill train.

Any problem in one of the members of this chain results in production losses and possibly even in casting stoppage. For this reason, so-called buffers are provided in the event that problems occur. For example, the equalizing furnace was extended by a buffer zone or a trouble period of up to 10 minutes of casting capacities. In the event of an assumed casting speed of 5.5. m/min, this results in an additional furnace portion having a length of about 55 m. However, when the trouble period is exceeded, this inevitably leads to casting stoppage with the attendant disadvantageous consequences. A further extension of the equalizing furnace is economically not acceptable because, on the one hand, the space required by the entire arrangement and correspondingly the costs for the arrangement increase and, on the other hand, the investment costs for the furnace itself would exceed an amount which would no longer be economically acceptable. In addition, a further extension of the equalizing furnace would mean that unoccupied storage sections of the furnace would also have to be heated during normal operation, so that the energy requirements would reach uneconomical levels.

SUMMARY OF THE INVENTION

Starting from the difficulties, limitations and disadvantages of the prior art described above, it is the object of the present invention to provide a method and an arrangement for the manufacture of hot-rolled strips or sections from continuously cast primary material in successive work steps of a closed process chain according to CSP technology, in which relatively long interruptions of the rolling process can be bridged while avoiding material and energy losses and particularly while avoiding casting stoppages.

In accordance with the present invention, in a method of the above-described type, for bridging a relatively long interruption of the rolling process, any primary material obtained during the uninterrupted casting process is divided into slab pieces having a predetermined length and the slab pieces are moved out of the process chain by means of a furnace part constructed as a transverse conveyer and the slab pieces are conveyed into a side line laterally and parallel offset next to the production line, the slab pieces are stored as necessary and stacked in a holding furnace and, after the interruption has been eliminated, the slab pieces are returned in the reverse direction into the process chain.

Accordingly, as a result of the method of operation according to the present invention, the arrangement of a buffer zone in the equalizing furnace is unnecessary and even relatively long interruptions in the rolling process can be bridged without interrupting the casting process.

In accordance with a development of the invention, slab pieces moved into the side line are heated to rolling temperature or are maintained at rolling temperature in the end position of the furnace part. This provides the advantage that further energy losses are avoided.

In accordance with a further development of the method for bridging long periods of interruption according to the present invention, slab pieces moved out of the production line are placed in a primary strip storage location at the exit side of the equalizing furnace, the slab pieces are collected and/or stacked in the storage location and are returned in a cycle as required at the entry side of the equalizing furnace, the slab pieces are heated to rolling temperature and are returned to the rolling process, preferably during a casting interruption. The slab pieces removed from the primary strip storage location can be heated to rolling temperature or can be maintained at rolling temperature in the furnace after having been moved into the furnace.

In the event that during a comparatively even longer interruption due to problems in the rolling proces the storage possibilities of the side line should not be sufficient in order to minimize material losses during the bridging of the trouble period, the present invention provides the additional feature that the slab pieces moved out of the production line are transported onto a roller conveyor, are moved by the roller conveyor as necessary onto an auxiliary roller conveyor and are cut by means of a cutting unit into pieces and are discarded.

In an arrangement for manufacturing hot-rolled strips or sections from continuously cast primary material in successive work steps of a closed process chain and arrangement chain, particularly for carrying out the method according to the present invention, wherein the arrangement includes a continuous casting plant, an equalizing furnace and a rolling mill arranged in a production line, the present invention provides the improvement that at the exit side of the equalizing furnace a first furnace part includes means for transversely conveying the slab pieces between the production line and a side line.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

DESCRIPTION OF THE PREFERRED EMBODIMENTS

Figure 1:
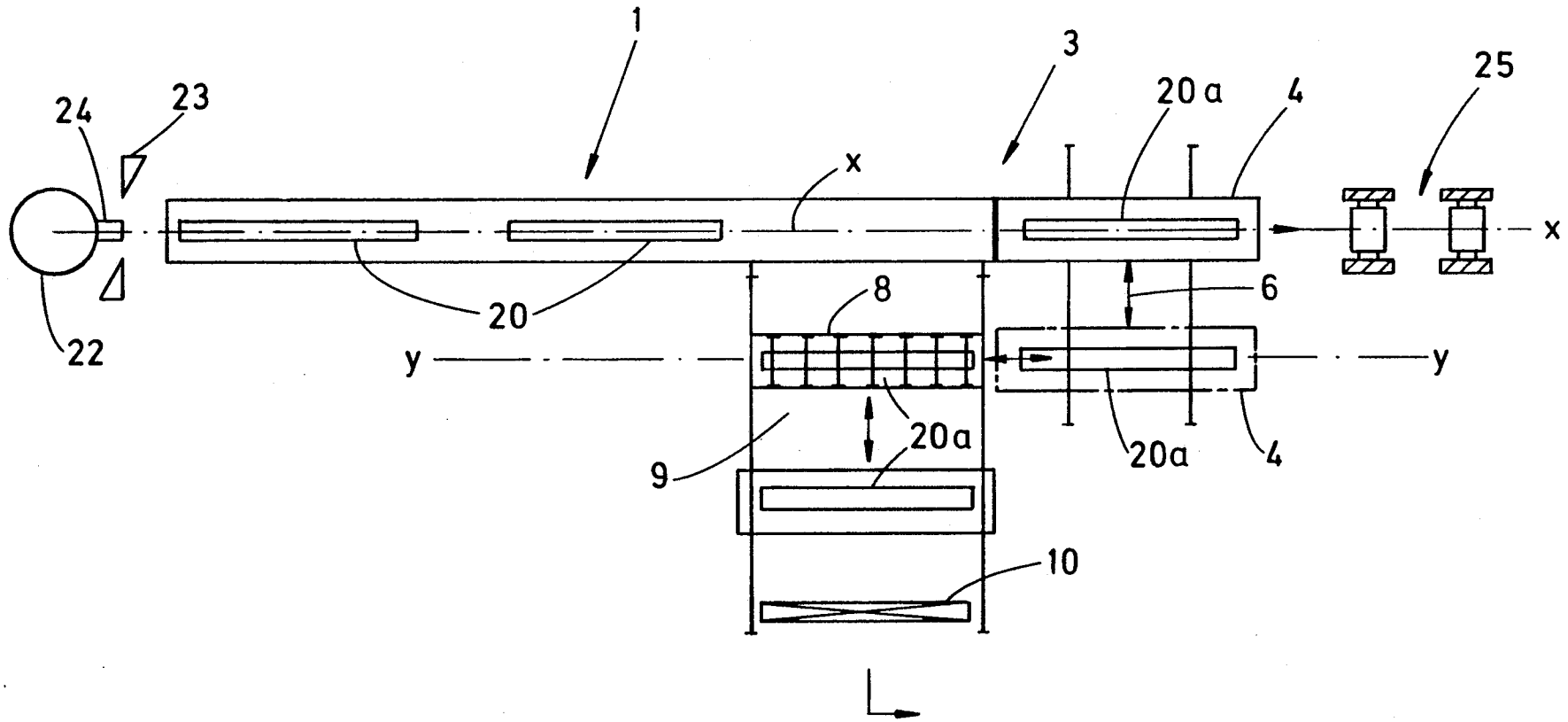
FIG. 1 is a schematic illustration of an arrangement according to the present invention with a furnace part constructed as a transverse conveyor arranged at the exit side of the equalizing furnace and with a holding furnace for slab pieces arranged in a side line.

As illustrated in FIG. 1 of the drawing, an arrangement for manufacturing hot-rolled strips or sections includes a CSP continuous casting plant 22 for producing continuously cast primary material 24. Oscillating shears 23 arranged following the continuous casting plant 22 divide the primary material into individual slab pieces 20 of predetermined length. The slab pieces 20 are introduced into the equalizing furnace 1 and are heated to rolling temperature or are maintained at rolling temperature in the furnace 1. From the equalizing zone of the furnace 1, the slab pieces are accelerated to the speed of the initial pass in the finishing train 25 and are rolled in the finishing train 25 to the predetermined final dimension.

A first furnace part 4 with means for transverse conveyance 6 between the production line x—x and a side line y—y is provided at the exit side 3 of the equalizing furnace 1. The furnace part 4 includes means, not shown,, for heating the slab pieces 20*a* received by the furnace part 4. These means for heating are constructed in such a way that they are also effective in a position of the furnace part 4 in the side line y—y. As a result, it is possible to heat to rolling temperature or maintain at rolling temperature the slab piece 20*a* received in the side line y—y by the rear furnace part 4 or the transverse conveyor.

Also arranged in the side line y—y are a first roller conveyor 8 and a holding furnace 9 for slab pieces 20*a* arranged preferably laterally of the roller conveyor 8, as well as a charging unit 10 which extends over the roller conveyor 8 and the holding furnace 9 and connects the roller conveyor 8 and the holding furnace 9.

Figure 2:
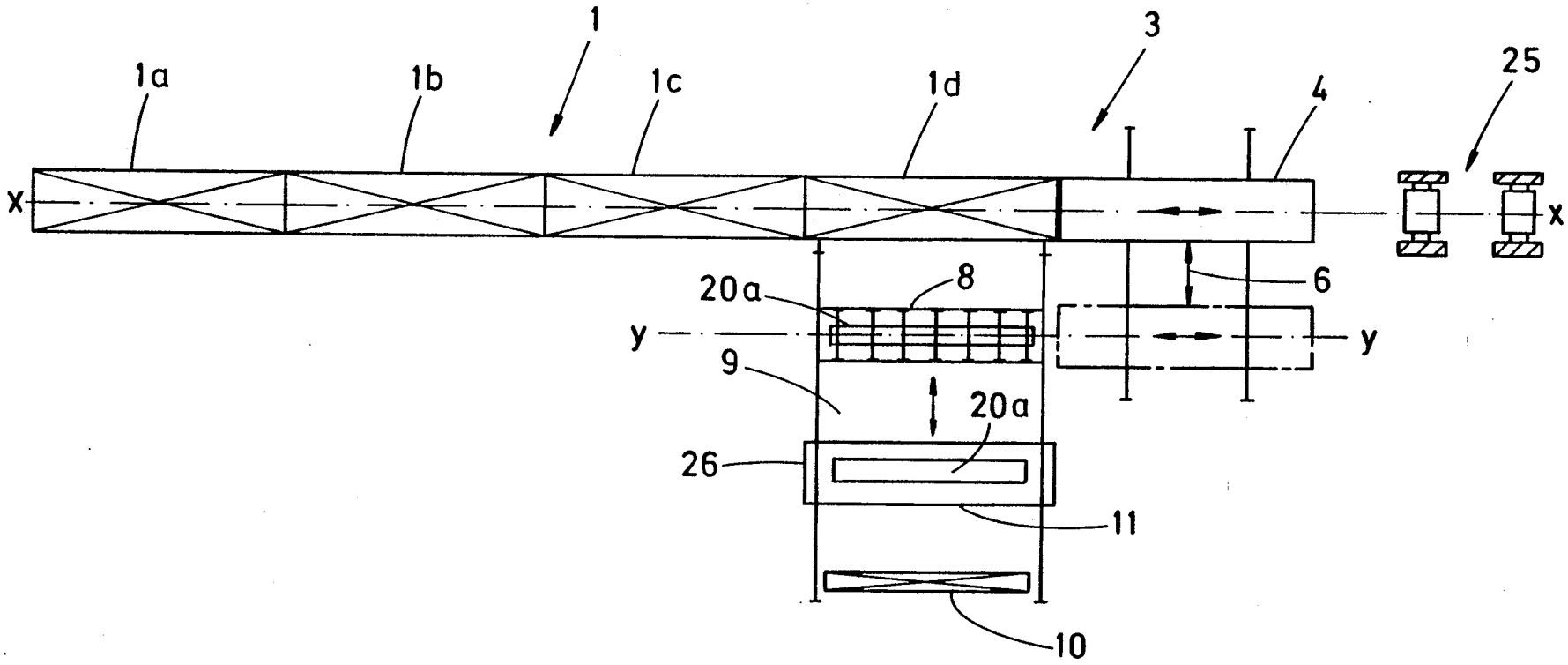
FIG. 2 is a schematic illustration of an arrangement similar to the arrangement of FIG. 1, wherein the equalizing furnace is divided into individual heating zones.

The arrangement shown in FIG. 2 differs from the arrangement shown in FIG. 1 only in that the equalizing furnace 1 is divided into individual heating zones 1*a*, 1*b*, 1*c*, 1*d*. The remaining elements of the arrangement are the same as those of the arrangement according FIG. 1. The holding furnace 9 of this arrangement may be a pit furnace 26.

Figure 3:
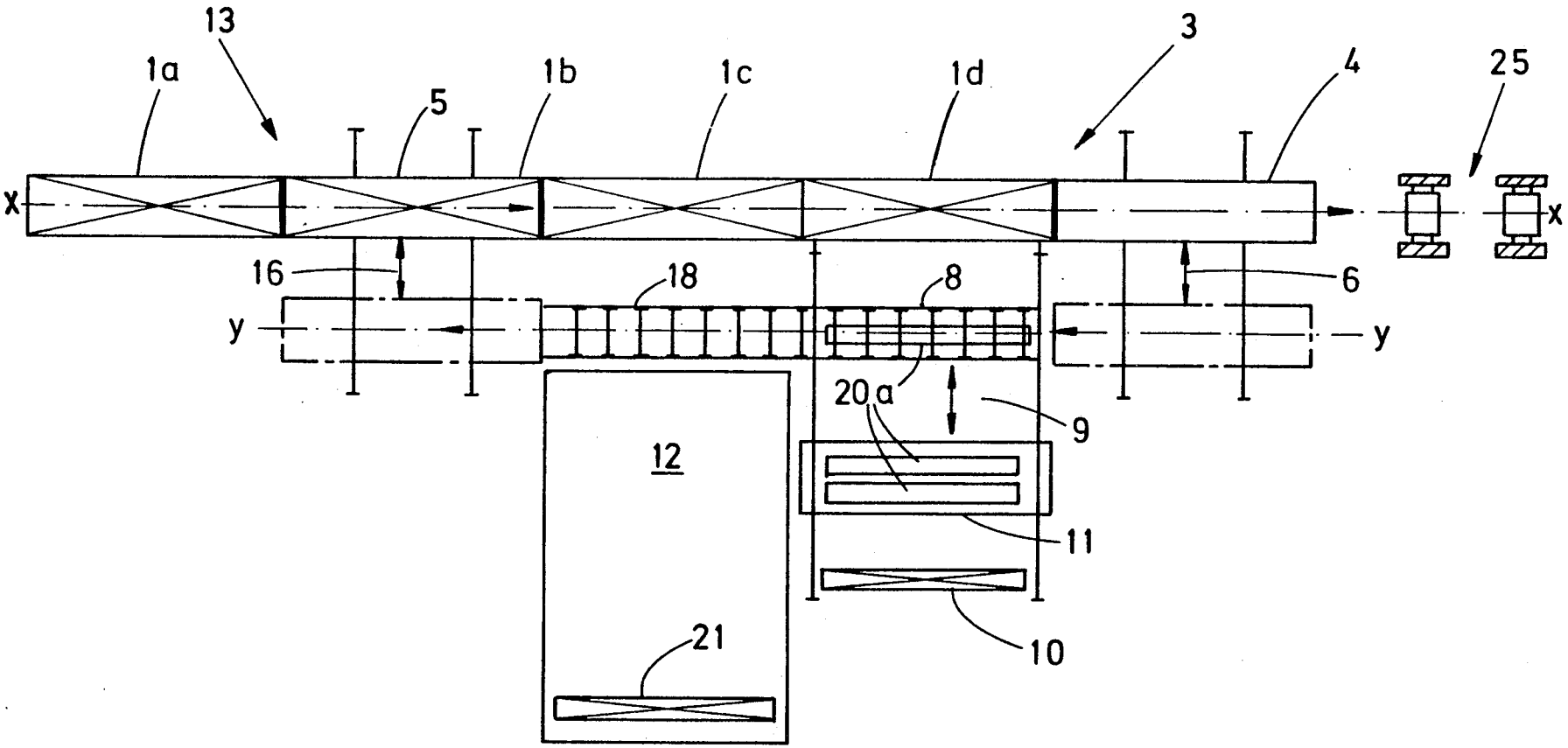
FIG. 3 is a schematic illustration of a further development of the arrangements of FIGS. 1 and 2, including a primary strip cooling unit in the side line and a second front furnace part constructed as transverse conveyor.

FIG. 3 of the drawing shows another development of the arrangement according to the present invention. The holding furnace 9 may include primary strip storage locations 11 with cover hoods. A second or additional furnace part 5 is provided on the entry side 13 of the equalizing furnace 1. The second or additional furnace part 5 is constructed as a transverse conveyor for conveying the slab pieces between the production line x—x and the side line y—y, as indicated by double arrow 16. A primary strip cooling storage unit 12 is provided between the transverse conveyor 5, 16 and the holding furnace or pit furnace 9. A second roller conveyor 18 and, if necessary, a charging unit 21 are provided for the primary strip cooling storage unit 12.

Figure 4:
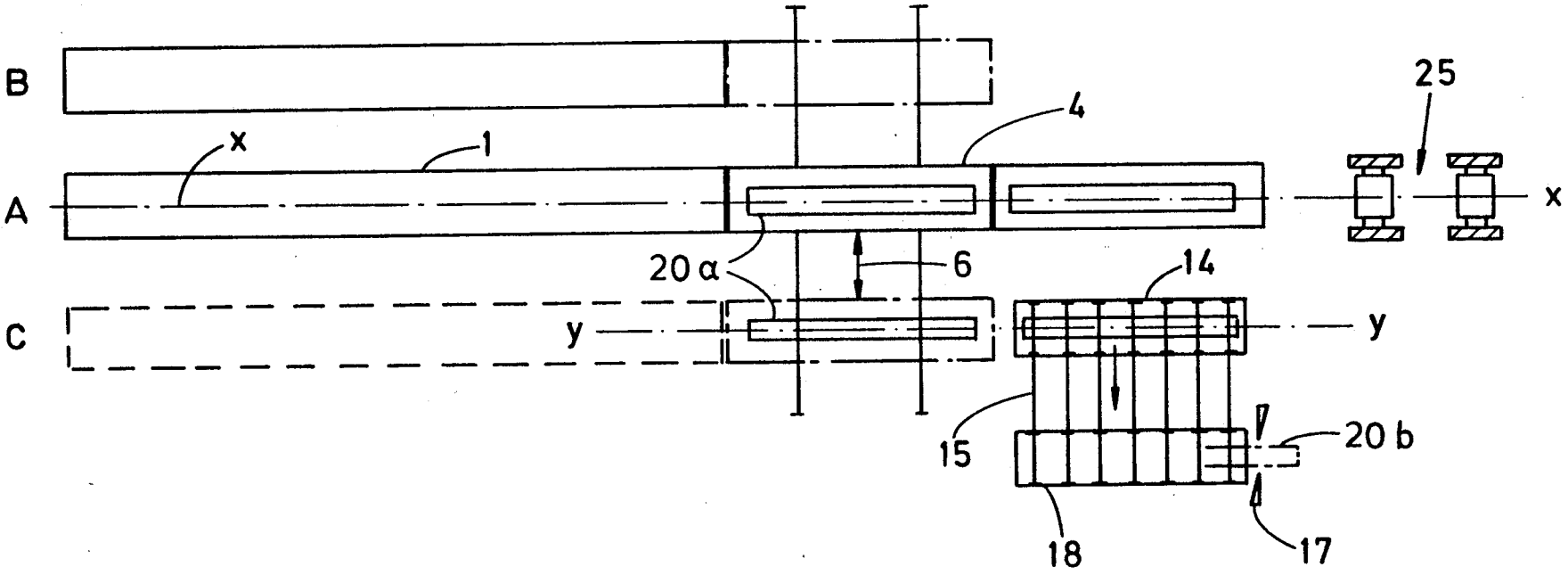
FIG. 4 is a schematic illustration of a multiple-strand arrangement with auxiliary roller conveyors arranged in the side line.

FIG. 4 of the drawing shows a multiple-strand arrangement with an equalizing furnace 1. In this arrangement, the first or rearward furnace part 4 is configured as a transverse conveyor which connects the three strands A, B, C. The transverse conveyor or furnace part 4 follows a first auxiliary roller conveyor 14 arranged in the side line y—y and this first auxiliary roller conveyor 14 can be connected to a second auxiliary roller conveyor 18 through a transverse conveying unit 15. The second auxiliary roller conveyor 18 includes a flame cutting machine 17 for dividing the thin slabs 20*a* into short pieces 20*b*.

The operation of the above-described arrangement and the method sequence according to the present invention provide that, for bridging a relatively long interruption due to problems in the rolling process, any primary material 24 obtained in the uninterrupted casting process of the CSP continuous casting plant 22 is divided into slab pieces 20 of predetermined length and that, during the duration of the trouble period, the strand pieces 20 are moved out of the process chain by means of a furnace part 4 constructed as a transverse conveyor and that the slab pieces 20 are moved into the laterally and parallel offset side line y—y next to the production line x—x, are stored if necessary through the roller conveyor 8 in a holding location 9, are stacked in the holding location 9 and, after the trouble has been removed, are returned in the reverse direction and sequence into the process chain.

The charging unit 10 is used for conveying the slab pieces 20 from the roller conveyor 8 to the holding location 9. The charging unit 10 includes gripping and conveying devices for the slab pieces 20*a*.

In accordance with the invention, the holding location 9 may be a furnace, for example, a pit furnace 11. The primary strips or thin slabs 20*a* are stacked in the holding furnace and are heated to rolling temperature or maintained at rolling temperature in the holding furnace. The slab pieces are conveyed in the reverse direction preferably during a casting intermission by means of the charging unit 10 through the roller conveyor 8 into the transverse conveyor 4 which introduces the primary strip 20 into the finishing train 25 after having been moved into the rolling line x—x.

As FIG. 2 further shows, the furnace 1 can be divided into heating zones 1*a* to 1*d*. The number of these zones depends on the length of the furnace and the length of the primary strip. For heating the primary strip 20*a* arriving from the holding location 9 to rolling temperature, the primary strips are moved backwards into the furnace 1. After the rolling temperature has been reached, the strips 20*a* are conveyed through the transverse conveyor 4 which has been moved into the production or rolling line x—x to the finishing train 25 and, after the strips have been accelerated to the speed of the initial pass, are finish-rolled in the finishing train.

In the embodiment of the arrangement according to the present invention shown in FIG. 3 and in the method of operation used in the arrangement of FIG. 3, the furnace part 13 at the entry side is additionally constructed as a transverse conveyor 5. By means of the two transverse conveyors 4, 5 which can be moved back and forth, the primary strips 20*a* stored in the holding location 9 can be conveyed in a cycle through the furnace 1 or the heating zones 1*b*, 1*c*, 1*d* thereof to the rolling mill or to the finishing train 25. The primary strip cooling storage unit 12 between the transverse conveyor 5 and the holding location with pit furnace 9 is provided in the event that primary strips 20*a* have to be moved out of the cycle and have to be stored for a longer period of time.

FIG. 4 of the drawing shows another solution used in multiple-strand arrangements. As illustrated in FIG. 4, two or three strands A, B, C are provided. In accordance with the present invention, the transverse conveyors 4 can be moved with thin slabs 20*a* into a position in the side line y—y, for example, if a relatively long trouble period of the finishing train 25 occurs. The thin slab 20*a* can then be transported to the auxiliary roller conveyor 14 and from this auxiliary roller conveyor 14 through the transverse conveying unit 15 onto a second auxiliary roller conveyor 18. The slab is then cut by means of a flame cutting machine 17 into short pieces 20*b* which can be sold.

While specific embodiments of the invention have been shown and described in detail to illustrate the inventive principles, it will be understood that the invention may be embodied otherwise without departing from such principles.

We claim:

1. In a method for manufacturing hot-rolled strips or sections form continuously cast primary material in successive work steps in a production line of a closed process chain, the method including dividing an endless primary material obtained by an uninterrupted casting process after solidification into individual slab pieces of predetermined length, heating the slab pieces in an equalizing furnace to rolling temperature and subsequently rolling the slab pieces into predetermined final dimensions, wherein, for bridging a comparatively short interruption of the rolling process, a slab piece obtained from the uninterrupted casting process is moved into a buffer zone of the equalizing furnace, the improvement comprising, for bridging a relatively long interruption of the rolling process, dividing primary material obtained during the uninterrupted casting process in slab pieces having a predetermined length, moving the slab pieces out of the process chain by means of a furnace part in the form of a transverse conveyor, conveying the slab pieces into a side line laterally and parallel offset next to the production line, storing the slab pieces as necessary in a holding furnace, heating the slab pieces in the holding furnace to rolling temperature of maintaining the slab pieces in the holding furnace at rolling temperature, and stacking the slab pieces in the holding furnace, and, after the interruption has been eliminated, returning the slab pieces in reverse direction into the process chain.

2. The method according to claim 1, wherein the slab pieces moved into the side line are heated to rolling temperature or are maintained at rolling temperature in an end position of the furnace part.

3. The method according to claim 1, comprising placing the slab pieces moved out of the production line into a primary strip storage location at an exit side of the equalizing furnace, collecting and/or stacking the slab pieces in the storage location by means of a charging unit and returning the slab pieces in a cycle as required at an entry side of the equalizing furnace, heating the slab pieces to rolling temperature and returning the slab pieces to the rolling process.

4. The method according to claim 3, wherein the slab pieces are returned to the rolling process during a casting interruption.

5. The method according to claim 3, wherein slab pieces collected in the primary strip storage location are heated to rolling temperature or are maintained at rolling temperature.

6. The method according to claim 1, comprising transporting the slab pieces moved out of the production line onto a roller conveyor, moving the slab pieces by means of the roller conveyor as necessary onto an auxiliary roller conveyor and cutting the slab pieces into smaller pieces and discarding the smaller pieces.

7. In an arrangement for manufacturing hot-rolled strips or sections from continuously cast primary material in successive work steps of a closed process and arrangement chain, the arrangement including a compact strip production continuous casting plant, an equalizing furnace and a rolling mill, the continuous casting plant, the equalizing furnace and the rolling mill being arranged in a production line, the improvement comprising the equalizing furnace having a first furnace part at an exit side of the equalizing furnace, the first furnace part comprising means for transversely conveying the first furnace part between the production line and a side line, and wherein the first furnace part comprises means for heating slab pieces received by the first furnace part, wherein the heating means are configured to be effective when the first furnace part is in the production line and when the first furnace part is in the side line.

8. The arrangement according to claim 7, comprising means for continuously heating the first furnace part.

9. The arrangement according to claim 7, wherein the side line comprises a first roller conveyor and a holding location for slab pieces arranged laterally adjacent the first roller conveyor, and a charging unit extending over the first roller conveyor and the holding location and connecting the first roller conveyor and the holding location.

10. The arrangement according to claim 9, wherein the holding location is a pit furnace.

11. The arrangement according to claim 9, wherein the holding location comprises storage locations for primary strip with cover hoods.

12. The arrangement according to claim 7, wherein the equalizing furnace is arranged in the production line and comprises a plurality of heating zones and means for continuously conveying strips through the equalizing furnace.

13. The arrangement according to claim 7, wherein the entire equalizing furnace is a heating furnace and includes means for continuously conveying strips through the equalizing furnace.

14. The arrangement according to claim 9, wherein the equalizing furnace comprises at an inlet side thereof a second, forward furnace part with means for transversely conveying the second furnace part between the production line and the side line.

15. The arrangement to claim 14, comprising a primary strip cooling storage unit between the second furnace part and the holding location, and a second roller conveyor adjacent the primary strip cooling storage unit.

16. The arrangement according to claim 15, comprising a charging unit for the second roller conveyor.

17. The arrangement according to claim 7, wherein the continuous casting plant has a plurality of strands, an equalizing furnace being provided in each strand, each equalizing furnace having a furnace part at an exit side thereof, the arrangement comprising transverse conveyors for connecting the furnace parts, the furnace parts being connected to each other through a first auxiliary roller conveyor arranged in the side line, and a transverse conveying unit for connecting the first auxiliary roller conveyor to a second auxiliary roller conveyor, the second auxiliary roller conveyor having a flame cutting machine for dividing the slab pieces into shorter pieces.

* * * * *